US006878438B2

(12) United States Patent
Takai et al.

(10) Patent No.: US 6,878,438 B2
(45) Date of Patent: Apr. 12, 2005

(54) HEAT RESISTANT COATED MEMBER

(75) Inventors: Yasushi Takai, Takefu (JP); Noriaki Hamaya, Takefu (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

(21) Appl. No.: 10/173,031

(22) Filed: Jun. 18, 2002

(65) Prior Publication Data

US 2003/0017338 A1 Jan. 23, 2003

(30) Foreign Application Priority Data

Jun. 18, 2001 (JP) ..... 2001-183503

(51) Int. Cl.[7] ..... H01F 7/02

(52) U.S. Cl. ..... 428/332; 128/408; 128/697; 128/699; 128/701; 128/702

(58) Field of Search ..... 428/408, 701, 428/702, 332, 699, 697, 472

(56) References Cited

U.S. PATENT DOCUMENTS 4,701,384 A * 10/1987 Sarin et al.
4,975,261 A * 12/1990 Takabatake ..... 423/445 R
5,202,293 A * 4/1993 Okamoto et al. ..... 501/95.2
5,221,336 A * 6/1993 Horton ..... 106/38.2
5,418,015 A * 5/1995 Jackson et al.
5,443,892 A * 8/1995 Holcombe et al.
5,527,442 A * 6/1996 Sekhar et al. ..... 428/627
5,552,008 A * 9/1996 Hecht et al. ..... 156/174
5,554,354 A * 9/1996 Sugino et al. ..... 428/307.3
5,759,932 A * 6/1998 Sangeeta et al. ..... 501/85
5,993,970 A 11/1999 Oscarsson et al.
6,432,536 B1 * 8/2002 Hecht et al. ..... 428/408

FOREIGN PATENT DOCUMENTS

JP 04322845 * 11/1992
JP 2000044843 * 2/2000
JP 2000-509102 A 7/2000

* cited by examiner

*Primary Examiner*—Archene Turner
(74) *Attorney, Agent, or Firm*—Birch, Stewart, Kolasch & Birch, LLP.

(57) ABSTRACT

A coated member in which a substrate made of Mo, Ta, W, Zr or carbon is coated with a yttrium-containing oxide is sufficiently heat resistant to use as a jig in the sintering or heat treatment of metals or ceramics in vacuum or an inert or reducing atmosphere at a temperature below 1300° C.

10 Claims, No Drawings

HEAT RESISTANT COATED MEMBER

This invention relates to a heat resistant coated member which is used in the sintering or heat treatment of metals or ceramics in vacuum or an inert or reducing atmosphere at a temperature below 1300° C.

BACKGROUND OF THE INVENTION

As the tray used in the sintering of cermets at a temperature of 1300 to 1500° C., JP-A 2000-509102 discloses a tray in which a substrate of graphite is coated with $Y_2O_3$ containing up to 20% by weight of $ZrO_2$. The tray of this patent publication has the problem that reaction can take place between yttrium oxide and graphite at elevated temperatures of 1500° C. or higher or in a reducing atmosphere to partially form yttrium carbide, inviting a reduced mechanical strength and a stripping likelihood. Then it was also proposed to form an interlayer of at least one element of Mo, W, Nb, Zr and Ta between yttrium oxide and graphite for inhibiting the reaction therebetween. However, the provision of the interlayer requires additional steps and increased costs. It is also a problem that graphite tends to adsorb airborne moisture and carbon dioxide gas and release the once adsorbed moisture and gas in vacuum.

SUMMARY OF THE INVENTION

An object of the invention is to provide a heat resistant coated member which is used in the sintering or heat treatment of metals or ceramics in vacuum or an inert or reducing atmosphere at a temperature below 1300° C.

It has been found that when a heat resistant coated member which is used in the sintering or heat treatment of metals or ceramics in vacuum or an inert or reducing atmosphere at a temperature below 1300° C. is prepared by forming its substrate from a material selected from among Mo, Ta, W, Zr and C and coating the substrate with a yttrium-containing oxide, the resulting coated member is highly heat resistant and least vulnerable to crazing and corrosion.

Therefore, the invention provides a heat resistant coated member which is used in the sintering or heat treatment of metals or ceramics in vacuum or an inert or reducing atmosphere at a temperature below 1300° C., wherein a substrate comprising a material selected from among Mo, Ta, W, Zr and carbon is coated with a yttrium-containing oxide. Most often, the yttrium-containing oxide has a thickness of 0.02 to 0.4 mm. The substrate is typically made of carbon having a density of at least 1.5 g/cm$^3$.

DESCRIPTION OF THE PREFERRED EMBODIMENT

For the member which is used in the sintering or heat treatment of a metal or ceramic in vacuum or an inert or reducing gas atmosphere at a temperature below 1300° C. to form an article, the type of substrate or the type of coating oxide or a combination thereof must be changed for optimization, depending on the type and service temperature of the article and the type of gas used. For the heat resistant, corrosion resistant member which is used when an article is prepared by heating or sintering a metal or ceramic at a temperature below 1300° C., the invention uses a substrate formed of a material selected from among Mo, Ta, W, Zr and carbon. The substrate may be a laminate of layers formed of such materials. When carbon is used in the substrate, the carbon substrate should preferably have a density of at least 1.5 g/cm$^3$. It is noted that the true density of carbon is 2.26 g/cm$^3$. A substrate with a density of less than 1.5 g/cm$^3$ is resistant to thermal shocks due to the low density, but has the issue that due to the high porosity, it is likely to adsorb airborne moisture and carbon dioxide gas and release the once adsorbed moisture and gas in vacuum. From the standpoint of reactivity of the substrate with the coating oxide, it is preferred to use a substrate formed of a material selected from among Mo, Ta and W. To facilitate formation of the coating on the substrate, it is preferred that the coating oxide have a coefficient of thermal expansion of $4\times10^{-6}$ to $7\times10^{-6}$.

According to the invention, the substrate is covered with a yttrium-containing oxide. It is acceptable to admix the yttrium-containing oxide with up to 20% by weight of an oxide of a metal selected from Groups 3A to 8 and preferably, an oxide of at least one metal selected from among Al, Si, Zr, Fe, Ti, Mn, V and rare earth metals (excluding Y).

The yttrium-containing oxide used herein may be in the form of particles having an average particle size of 10 to 70 $\mu$m. The inventive member is prepared by plasma spraying or flame spraying the yttrium-containing oxide particles onto the substrate in an inert atmosphere of argon or the like. Prior to the spraying of the yttrium-containing oxide particles, the substrate may be surface treated as by blasting.

The yttrium-containing oxide covering the substrate should preferably have a thickness of 0.02 mm to 0.4 mm, and more preferably 0.1 mm to 0.2 mm. An oxide coating of less than 0.02 mm may allow, after repeated use, the substrate to react with a material to be sintered within the tray. An oxide coating of more than 0.4 mm may crack by thermal shocks, allowing oxide fragments to separate off and contaminate the article being sintered.

In one preferred embodiment, the yttrium-containing oxide particles are sprayed so that the coating has a surface roughness (Ra) of at least 2 $\mu$m, and then the coating surface may be worked as by polishing, if necessary. For effective sintering of an article resting on the coating surface, the surface roughness (Ra) of the oxide coating is preferably 2 $\mu$m to 30 $\mu$m, and more preferably 3 $\mu$m to 10 $\mu$m. A surface roughness (Ra) of less than 2 $\mu$m indicates that the oxide coating has a substantially flat surface which can hinder sintering shrinkage of the article.

The heat resistant coated member thus obtained according to the invention is suitable as a tray or part for use in the sintering or heat treatment of metals or ceramics at a temperature below 1300° C. in vacuum or an inert atmosphere or a reducing atmosphere, preferably having an oxygen partial pressure of up to 0.01 MPa. The coated member of the invention is advantageously used when a material is heated or sintered at a temperature of about 900 to 1200° C. for about 1 to 50 hours, although the use condition depends on the type of material to be sintered.

The inert atmosphere is, for example, of Ar or $N_2$. The reducing atmosphere is, for example, an atmosphere using an inert gas and a carbon heater, or an atmosphere of an inert gas admixed with several percents of hydrogen gas. An oxygen partial pressure of 0.01 MPa or lower in the atmosphere ensures that the member is kept resistant to corrosion.

Suitable metals and ceramics include rare earth-transition metal alloys, titanium alloys, silicon carbide, and compound rare earth oxides. The coated member in the form of a part according to the invention is effective for use in the manufacture of rare earth-transition metal alloys. Specifically, the coated member of the invention is effective for use in the manufacture of Sm—Co base alloys, Nd—Fe—B base alloys, and Sm—Fe—N base alloys to form sintered magnets, Tb—Dy—Fe alloys to form sintered magnetostrictive elements, and Er—Ni alloys to form sintered regenerators. It is also useful as a crucible for metal or alloy melting, and a setter, tray and sagger for magnet manufacture.

The coated member of the invention is fully resistant to heat and useful in the sintering or heat treatment of metals or ceramics in vacuum or an inert or reducing atmosphere at a temperature below 1300° C.

EXAMPLE

Examples of the invention are given below by way of illustration and not by way of limitation.

Examples 1–4 & Comparative Examples 2–5.

Substrates of Mo, Ta, W and carbon dimensioned 50 mm×50 mm×5 mm were furnished. Prior to plasma spraying, the surface of each substrate was roughened by blasting. Then yttrium oxide ($Y_2O_3$) particles having an average particle size as shown in Table 1 were plasma sprayed to the substrate surface using argon/hydrogen as the plasma forming gas, yielding a heat resistant coated member.

Physical properties of the coated members were measured with the results shown in Table 1. The composition was analyzed by inductively coupled plasma-atomic emission spectroscopy (ICP-AES) (Seiko SPS-4000). The average particle size was measured by the laser diffraction method (FRA by Nikkiso K.K.). Physical properties of the sprayed coating were measured with the results shown in Table 2. The thickness of the sprayed coating was determined from a photomicrography taken on a cross section under an optical microscope. Surface roughness (Ra) was measured by a surface roughness meter (SE3500K by Kosaka Laboratory K.K.).

Using a carbon heater furnace having a predetermined atmosphere (vacuum, Ar or $N_2$+$H_2$), the coated members were heated to a predetermined temperature (1250, 1400 or 1600° C.) at a rate of 400° C./hr, held at the temperature for a predetermined time (4 hr), and cooled down at a rate of 400° C./hr. This thermal cycling was repeated 5 times. The outer appearance of the coated members was visually observed. The results are shown in Table 2.

Comparative Example 1

A Mo substrate dimensioned 50 mm×50 mm×5 mm was furnished. Physical properties of the substrate were measured with the results also shown in Table 1. As in Examples, using a carbon heater furnace having a vacuum atmosphere, the coated members were heated to the predetermined temperature at a rate of 400° C./hr, held at the temperature for the predetermined time, and cooled down at a rate of 400° C./hr. This thermal cycling was repeated 5 times. The outer appearance of the coated members was visually observed. The results are also shown in Table 2.

TABLE 1

| | Composition | Average particle size, μm | Substrate material | Substrate density, g/cm³ |
|---|---|---|---|---|
| Example 1 | $Y_2O_3$ | 60 | Mo | 10 |
| Example 2 | $Y_2O_3$ | 50 | Ta | 16 |
| Example 3 | $Y_2O_3$ | 40 | W | 19 |
| Example 4 | $Y_2O_3$ | 60 | C | 1.7 |
| Comparative Example 1 | — | — | Mo | 10 |
| Comparative Example 2 | $Y_2O_3$ | 60 | C | 1.7 |
| Comparative Example 3 | $Y_2O_3$ | 100 | C | 1.7 |
| Comparative Example 4 | $Y_2O_3$ | 60 | C | 1.3 |
| Comparative Example 5 | $Y_2O_3$ | 100 | C | 1.7 |

TABLE 2

| | Sprayed coat thickness, mm | Ra, μm | Heating atmosphere | Oxygen partial pressure, MPa | Temp., ° C. | Holding time, hr | Outer appearance |
|---|---|---|---|---|---|---|---|
| Example 1 | 0.15 | 10 | vacuum | 0.001 | 1250 | 4 | no change |
| Example 2 | 0.20 | 8 | Ar | 0.001 | 1250 | 4 | no change |
| Example 3 | 0.20 | 6 | $N_2$+ $H_2$ | 0.001 | 1250 | 4 | no change |
| Example 4 | 0.15 | 10 | vacuum | 0.0001 | 1250 | 4 | no change |
| Comparative Example 1 | — | 10 | vacuum | 0.0001 | 1250 | 4 | deformed |
| Comparative Example 2 | 0.50 | 10 | vacuum | 0.0001 | 1400 | 4 | stripped |
| Comparative Example 3 | 0.35 | 40 | Ar | 0.01 | 1600 | 4 | crazed |
| Comparative Example 4 | 0.35 | 10 | $N_2$ + $H_2$ | 0.01 | 1600 | 4 | crazed |
| Comparative Example 5 | 0.20 | 10 | vacuum | 0.01 | 1600 | 4 | crazed |

The coated members or jigs of Examples 1 to 4 remained unchanged after the heat treatment in the carbon heater furnace. The Mo substrate of Comparative Example 1 became irregular over the entire surface after the heat treatment in the carbon heater furnace, during which grains grew with some grains spalling off. The carbon substrates coated with yttrium oxide crazed when exposed to temperatures above 1300° C., allowing the substrates to corrode.

Japanese Patent Application No. 2001-183503 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A heat resistant coated member comprising a substrate consisting essentially of a material selected from the group consisting of Mo, Ta, W, and Zr, said substrate being coated with a layer comprising yttrium oxide, wherein the yttrium oxide is admixed with up to 20% by weight of an oxide of a metal selected from Groups 3A to 8 before coating on said substrate.

2. The heat resistant coated member of claim 1, wherein said yttrium oxide has the formula $Y_2O_3$.

3. The heat resistant coated member of claim 1, wherein the layer comprising yttrium oxide has a thickness of 0.02 to 0.4 mm.

4. The heat resistant coated member of claim 1, wherein the layer comprising yttrium oxide has a thickness of 0.1 mm to 0.2 mm.

5. The heat resistant coated member of claim 1, wherein the oxide of a metal selected from Groups 3A to 8 is an oxide of one or more metals selected from the group consisting of Al, Si, Zr, Fe, Ti, Mn, V, and rare earth metals other than yttrium.

6. A heat resistant coated member comprising a substrate consisting essentially of carbon having a density of at least 1.5 g/cm$^3$, said substrate being coated with a layer comprising yttrium oxide, wherein the yttrium oxide is admixed with up to 20% by weight of an oxide of a metal selected from Groups 3A to 8 before coating on said substrate.

7. The heat resistant coated member of claim 6, wherein said yttrium oxide has the formula $Y_2O_3$.

8. The heat resistant coated member of claim 6, wherein the layer comprising yttrium oxide has a thickness of 0.02 to 0.4 mm.

9. The heat resistant coated member of claim 6, wherein the layer comprising yttrium oxide has a thickness of 0.1 mm to 0.2 mm.

10. The heat resistant coated member of claim 6, wherein the oxide of a metal selected from Groups 3A to 8 is an oxide of one or more metals selected from the group consisting of Al, Si, Zr, Fe, Ti, Mn, V, and rare earth metals other than yttrium.

* * * * *